United States Patent [19]

Barry

[11] 4,270,800

[45] Jun. 2, 1981

[54] PRE-START WARNING DEVICE FOR A MACHINE

[75] Inventor: Michael J. Barry, Pontefract, England

[73] Assignee: Dresser Europe S.A., Brussels, Belgium

[21] Appl. No.: 26,207

[22] Filed: Apr. 2, 1979

[30] Foreign Application Priority Data

Apr. 12, 1978 [GB] United Kingdom ..... 14436/78

[51] Int. Cl.[3] ..... E21C 35/04

[52] U.S. Cl. ..... 299/1; 173/3; 175/38; 299/81

[58] Field of Search ..... 299/1, 17, 81; 175/38; 173/3; 239/71, 289; 160/5; 408/8; 318/471–473

[56] References Cited

U.S. PATENT DOCUMENTS

| | | | |
|---|---|---|---|
| 2,312,291 | 2/1943 | Tyson | 408/8 X |
| 2,576,808 | 11/1951 | Perkins | 137/468 X |
| 2,640,958 | 6/1953 | Davis | 160/5 X |
| 2,665,129 | 1/1954 | Durbin et al. | 318/473 X |
| 2,741,468 | 4/1956 | Alspaugh | 299/1 |
| 3,290,576 | 12/1966 | Jensen et al. | 318/471 |
| 3,398,690 | 8/1968 | Deaton | 318/471 X |
| 3,609,053 | 9/1971 | Klem | 239/71 X |
| 3,980,338 | 9/1976 | Weber | 299/1 |
| 4,068,893 | 1/1978 | Weirich | 299/43 |

FOREIGN PATENT DOCUMENTS

| | | | |
|---|---|---|---|
| 1815543 | 6/1970 | Fed. Rep. of Germany . | |
| 202296 | 6/1973 | Fed. Rep. of Germany . | |
| 2644665 | 6/1978 | Fed. Rep. of Germany . | |
| 404062 | 9/1978 | Sweden . | |
| 1333627 | 10/1973 | United Kingdom | 299/1 |

*Primary Examiner*—Ernest R. Purser
*Attorney, Agent, or Firm*—Larson and Taylor

[57] ABSTRACT

A machine pre-start warning device comprises at least one water spray nozzle and at least one temperature dependent resistor, the or each temperature dependent resistor being located with respect to a nozzle as to lie in the water jet emitted in use by the nozzle. The temperature dependent resistor is connected to a control circuit to actuate the control circuit upon sensing a water jet which circuit enables machine start-up to occur when the circuit is actuated and which otherwise prevents start-up from occurring.

6 Claims, 3 Drawing Figures

PRE-START WARNING DEVICE FOR A MACHINE

This invention relates to a pre-start warning device for a machine and to a machine incorporating such a device.

Several machine types currently incorporate pre-starting warning devices of various forms, for circumstances where the machine operator may not be able to establish with certainty that there are no other workmen in the vicinity of the machine and hence where it is necessary to give a warning of imminent machine start-up so that any workmen in the vicinity may move to a safe location.

For instance, pre-start warning devices are used on various types of mining equipment, such as coal face shearers, and conveyors of both the scraper chain and belt type. With conveyors, an audible tone is usually employed, whereas with shearers, the warning is usually the switch on of the water spray nozzles, normally employed during mineral winning operations for dust suppression purposes. With this last mentioned system, the machine operator turns on the water supply and then depresses the start button. Water pressure in a warning circuit acts upon a device which, after a predetermined time delay, causes a switch, in series with the start switch, to close and thus to start the machine. A safety feature in this system is that if the water supply is not turned on, it is not possible to start the machine. However, the above system has a drawback, for if a water nozzle(s) is blocked or a valve in the nozzle(s) is closed, then the system will still enable machine start-up to occur, because pressure sensing is employed, and even if it were changed to flow sensing, it could be defeated by a burst pipe.

According to a first aspect of the present invention, a machine pre-start warning device comprises at least one water spray nozzle and at least one temperature dependent resistor, the or each temperature dependent resistor being so located with respect to an individual nozzle as to lie in a water jet emitted in use by that nozzle, the temperature dependent resistor being connected to, and actuable upon, a control circuit upon sensing a water jet, and the control circuit, when actuated, enabling machine start-up to occur, and when non-actuated, preventing machine start-up from occurring.

According to a second aspect of the present invention, there is provided a shearer type mining machine incorporating a pre-start warning device as defined above.

Thus, the pre-start warning device in accordance with the invention positively requires the presence of a water jet at the nozzle(s) in the vicinity of which the temperature dependent resistor is located, before machine start-up can occur and hence the device precludes machine start-up should no water have been sprayed for whatever reason.

Conveniently the temperature dependent resistor may be a thermistor. Although it is envisaged that only one thermistor need be employed, it is possible to employ a plurality of thermistors each associated with an individual nozzle, with a simple bridge circuit as will be readily understood by those skilled in the art.

In detail, the voltage applied to the thermistor is so selected to give a desired level of self-heating above the anticipated ambient temperature e.g. that existing along a coal face. When a water jet impinges on the thermistor, the latter is cooled, thus changing its resistance and causing the current to change, which can be employed to actuate the control circuit.

The control circuit may comprise a transistor and a light emitting diode, the light emission of which is detected by a similar diode connected to a time delay circuit so that the warning water jet is sprayed for a predetermined time period before the time delay circuit energizes a relay or similar device in a conventional pilot circuit employed for machine start-up purposes.

Apart from its use with shearer type mining machines exemplified above, for winning coal, potash etc. the pre-start warning device in accordance with the invention could also be used on other machines employing liquid spraying or cooling systems such as quarrying machines and rotary boring tools.

The invention will now be described in greater detail by way of example, with reference to the accompanying drawings in which.

Figure 1:
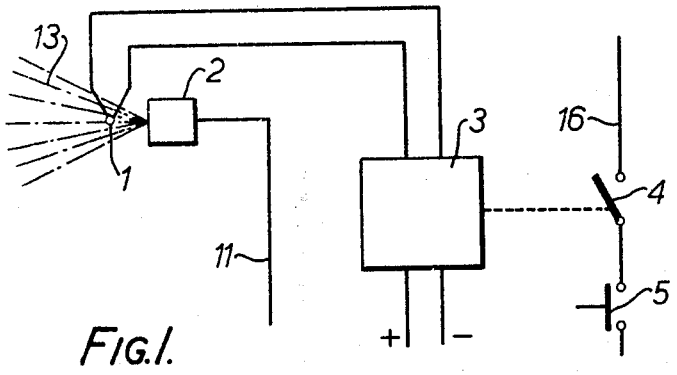
FIG. 1 illustrates diagrammatically the basic principle of operation of the device.

Referring to FIG. 1, a shearer type mining machine includes a water supply pipe 11, containing suitable filters, and terminating in a spray nozzle 2 mounted on the machine. A thermistor 1 is also mounted on the shearer and is connected to a control circuit 3, the thermistor being supplied with a voltage selected to give a level of self-heating above the ambient temperature in which the shearer is operating. Water from the nozzle impinging on the thermistor 1 causes the resistances of the thermistor to change which change triggers the circuit 3 and this in turn actuates a pilot circuit switch 4, after a suitable time delay period.

Figure 2:
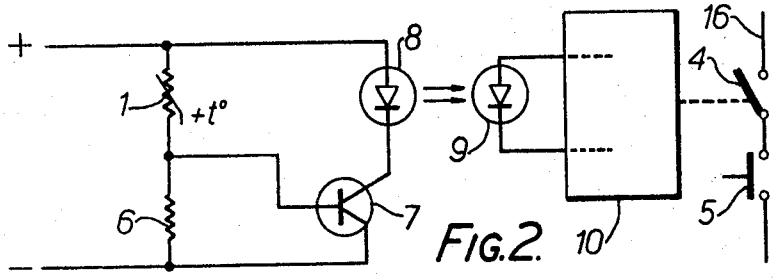
FIG. 2 shows a simple electrical circuit to enable the invention to be put into effect.
Figure 3:
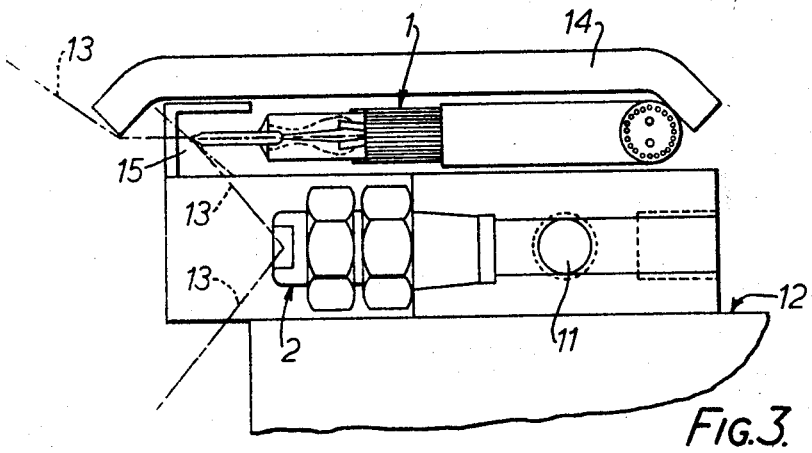
FIG. 3 is a sectional view through the pre-start warning device of FIGS. 1 and 2 mounted on a shearer type mining machine.

Referring to FIG. 2, with a predetermined voltage applied to the thermistor 1, the latter, in the conventional manner, self-heats and stabilizes at a particular power dissipation and circuit current. When the thermistor 1 is impinged upon by a water jet 13 from the spray nozzle 2, the resultant current change induces a corresponding voltage change across the resister 6, causing a transistor 7 to switch on a light emitting diode 8. The emission is detected by a similar diode 9, connected to a time delay circuit 10 which, after the predetermined time period has elapsed, energizes the relay 4 in a conventional shearer pilot circuit 16 to enable machine start-up to occur. Preferably, the thermistor 1 is mounted on the machine beneath a guard plate 14 and above the associated spray nozzle so that a tip 15 of the thermistor 1 projects into the conical jet 13. It is preferred for the tip 15 to project only slightly into the anticipated conical jet so as not to actuate the control circuit upon poor or inadequate spraying, which might give inadequate warning to workmen in the vicinity of the machine.

To start the machine, the operator turns on the water supply and depresses a machine start button 5. The conical water jet 13 emitted from the spray nozzle 2 impinges on the thermistor 1 which actuates the control circuit 3. This causes the switch 4 to be operated after a time delay as described above. Once the machine has started, the water spray can if desired be turned off, and the machine will still operate.

I claim:

1. A machine pre-start warning device comprising a water spray nozzle, a temperature dependent resistor located with respect to the nozzle to lie in a water jet emitted in use by the nozzle, a control circuit connected to the temperature dependent resistor to be actuated thereby upon the resistor sensing a water jet and means to enable machine start-up to occur in response to actuation of the control circuit and to prevent machine start-up from occurring unless the circuit is actuated.

2. A device as set forth in claim 1, in which the temperature dependent resistor is a thermistor.

3. A device as set forth in claim 1, in which the control circuit comprises a transistor, a first light emitting diode, a second similar diode to detect the light emission of the first diode, and a time delay circuit connected to the second diode so that the warning water jet is sprayed for a predetermined time period prior to machine start-up.

4. A shearer type mining machine incorporating a pre-start warning device as defined in claim 1, 2 or 3.

5. A mining machine as set forth in claim 4, in which the temperature dependent resistor is located above an associated nozzle.

6. A mining machine as set forth in claim 5 and comprising a guard plate located above the associated spray nozzle.

* * * * *